United States Patent [19]

Sivilotti

[11] Patent Number: 4,518,475

[45] Date of Patent: May 21, 1985

[54] APPARATUS FOR METAL PRODUCTION BY ELECTROLYSIS OF A MOLTEN ELECTROLYTE

[75] Inventor: Olivo G. Sivilotti, Kingston, Canada

[73] Assignee: Alcan International Limited, Montreal, Canada

[21] Appl. No.: 498,848

[22] Filed: May 27, 1983

[30] Foreign Application Priority Data

Jun. 14, 1982 [GB] United Kingdom ..... 8217165

[51] Int. Cl.[3] ..... C25C 3/00; C25C 3/04; C25C 7/00

[52] U.S. Cl. ..... 204/247; 204/64 R; 204/70; 204/243 R

[58] Field of Search ..... 204/64 R, 68–70, 204/243 R–247, 268

[56] References Cited

U.S. PATENT DOCUMENTS 1,079,079 11/1913 Wallace et al. ..... 204/70

3,907,651 9/1975 Andreassen et al. ..... 204/70

4,401,543 8/1983 Ishizuka ..... 204/244

*Primary Examiner*—Howard S. Williams

*Attorney, Agent, or Firm*—Cooper, Dunham, Clark, Griffin & Moran

[57] ABSTRACT

Electrolytic cells for production of Mg or other metal lighter than the molten electrolyte comprise electrode assemblies of anode 28, cathode 26 and intermediate bipolar electrodes 30 with substantially vertical regions 39 between them. The intermediate bipolar electrodes have open-top channels 50 along their top edges. An electrolyte/metal mixture rising from the interelectrode regions by gas lift is transported along these channels, substantially undisturbed by rising gas, to a weir 20 and then to a metal collection chamber 18. The electrolyte surface is kept at a constant level, preferably by means of a vessel 22 submerged in electrolyte in the metal collection chamber, to or from which molten electrolyte can be transferred to alter the surface level.

7 Claims, 9 Drawing Figures

APPARATUS FOR METAL PRODUCTION BY ELECTROLYSIS OF A MOLTEN ELECTROLYTE

Figure 1:
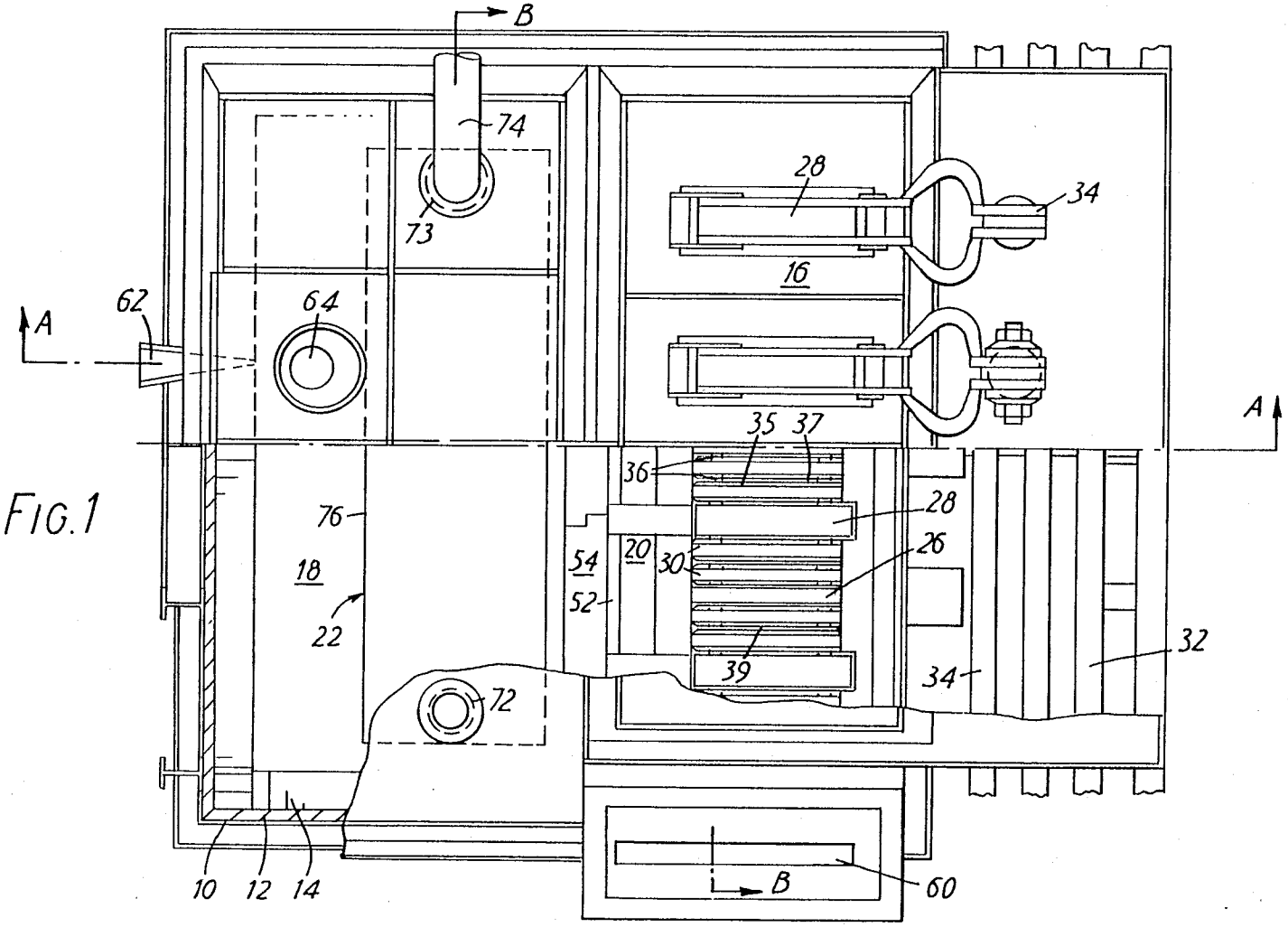

This invention relates to a method and a cell for metal production by electrolysis of a molten electrolyte which is more dense than the metal. The invention will be particularly described with reference to the production of magnesium by electrolysis of a molten electrolyte containing magnesium chloride. But it should be understood that the invention is also applicable to other electrolytes and other metals.

In the electrolysis of molten electrolytes containing magnesium chloride, magnesium is formed at the cathode and chlorine at the anode. Since both are lighter than the electrolyte, both migrate to the surface. If the magnesium and the chlorine come into contact with one another, they tend to re-combine, and this is a major case of production losses. The tendency is a function of the contact time, the intimacy of contact and the electrolyte temperature.

The classical solution to this problem was to separate anode and cathode regions by means of a diaphragm. But a diaphragm considerably increases the interelectrode distance and therefore the internal resistance of the cell and although this solution has been used commercially for many years, the more recent industrial practice has favoured diaphragmless cells. Cells without diaphragms may be divided into two categories:

(i) those cells designed to keep the magnesium generated at the cathode essentially free from contact with the chlorine generated at the anode. To do this, it is necessary to keep a substantial distance between facing electrodes, and this in turn means that a substantial amount of electrical energy must be spent overcoming the electrical resistance of the electrolyte. Such cells have high current efficiency because magnesium/chlorine recombination is substantially prevented.

(ii) those cells designed to use the chlorine to lift the magnesium droplets to the surface of the electrolyte. The anode/cathode spacing can be greatly reduced, thus reducing the internal resistance of the cell, but the current efficiency is lowered by reason of back reaction of Mg and $Cl_2$. The current efficiency of the cell is dependent upon the rapidity of separation of the product Mg from the generated chlorine. The cells of this invention are in category (ii).

One of the cells of category (i) is described in U.S. Pat. No. 4,055,474 by this inventor. In this cell use is made of inverted steel troughs extending above each cathode and beneath the surface of the bath to receive the rising metal and conducting it to a suitable metal collection locality separated from the main chlorine collecting chamber.

The same product separating technique has been recently proposed (European Patent Specification 27016A) for a cell provided with intermediate bipolar electrodes where inverted troughs are designed on the cathodic surfaces for the individual collection of magnesium metal and delivery outwards to a separate reservoir. A similar arrangement is suggested for the collection of chlorine on the anodic surfaces. The interelectrode spacings and the inclination of the electrode surfaces, especially the cathodic surfaces, are selected to satisfactorily separate the two products. Experience has shown that a minimum spacing of 5 cm is necessary to prevent mixing and therefore a substantial voltage drop results, even when the electrode geometry is optimized, from the passage of current at the densities required to produce commercial quantities of magnesium.

Multipolar cells of category (ii) have been proposed (U.S. Pat. Nos. 2,468,022 and 2,629,688) where the collection of magnesium is effected by circulating the electrolyte towards a metal collecting locality by means of a mechanical pump: the interelectrode spaces between bipolar vertical slabs are swept by the circulating electrolyte and the magnesium produced is made to overflow into a common sump disposed alongside the spaces and separated from them by submerged weirs which prevent the passage of chlorine from the electrolysis chamber and the sump. The metal is retained by a dam disposed in the metal collecting chamber, so that only electrolyte is pumped back into the electrolysis chamber. The operating difficulties arising from the need to maintain the pump in continuous use in spite of the difficult environment are well known to those skilled in the art. This may be the reason why these cells have not been very successful commercially.

We have now found a method to effect the separation of magnesium in cells of multipolar design by means of circulating electrolyte without the use of pumps. The electrolyte circulation is obtained by using small interelectrode spaces and a fairly high current density at the electrodes which leads to a high rate of lift of electrolyte (because of the high rate of chlorine flow in the interelectrode spaces) without however an excessive voltage drop (because of the small interelectrode distance) and to a satisfactory current efficiency (because of the very rapid separation of the products).

The present invention provides in one aspect an electrolytic cell for the production of a metal by electrolysis of a molten electrolyte which is more dense than the metal, comprising an electrolysis chamber including at least one electrode assembly of an anode, a cathode and at least one intermediate bipolar electrode, the electrodes being arranged substantially vertically with substantially vertical electrolysis regions between them, and a gas collection space above the assembly, a metal collection chamber in communication with the top and the bottom of the electrolysis chamber, but screened from the gas collection space, a weir to permit a controlled flow of electrolyte/metal mixture from the top of the electrolysis chamber to the metal collection chamber, which weir is positioned at one end of the or each electrode assembly and extends transversely to the electrodes, and means for maintaining the surface of the electrolyte/metal mixture at a substantially constant level, the or each intermediate bipolar electrode having a top edge, which extends adjacent one vertical face above the intended level of the electrolyte surface, and which is provided with a longitudinally-extending open-top channel which slopes downwards towards the weir to convey electrolyte metal mixture from the electrolysis region towards the weir.

The present invention provides in another aspect a process for the production of a metal by electrolysis of a molten metal chloride electrolyte which is more dense than the metal, which process comprises circulating the electrolyte between an electrolysis zone and a metal collection zone, in the electrolysis zone, introducing electrolyte from the metal collection zone into the lower ends of substantially vertical regions between the electrodes of one or more electrode assemblies each comprising an anode, a cathode and one or more intermediate bipolar electrodes, passing an electric current between the anode and the cathode whereby chlorine is generated at anodic electrode faces, the metal is generated at cathodic electrode faces, and an electrolyte/metal/chlorine mixture is caused to rise up the interelectrode regions, transporting the electrolyte/metal mixture which emerges from the upper ends of the interelectrode regions by means of open-top channels extending longitudinally of the electrodes over a weir adjacent one end of the assembly and thence to the metal collection zone, said transported mixture being maintained substantially undisturbed by chlorine rising from the interelectrode regions, and maintaining the liquid level substantially constant at a value to control the flow of electrolyte/metal mixture along the channels, and over the weir at a rate slow enough, and without excessive turbulence, to effect substantially complete removal of chlorine but fast enough to maintain molten metal droplets entrained in the electrolyte.

The cells of this invention are designed to operate at temperatures only slightly above the melting point of the metal being produced, so as to minimise back-reaction between the metal and chlorine. When used to produce magnesium (M.P. 651° C.) the cell is preferably operated at 655° C.-695° C., particularly 660° C. to 670° C.

The cells of this invention are designed to be operated at fairly high current densities, typically from 0.3 $A/cm^2$ to 1.5 $A/cm^2$, and small interelectrode spacings, typically, 4 mm to 25 mm. The anodes and intermediate bipolar electrodes are preferably of graphite, but may be a composite with a graphite anodic face and a steel cathodic face. Under these conditions, electrode dimensions are rather critical to cell efficiency, so all normal precautions must be taken to prevent entry of air or moisture into the electrolysis chamber so as to reduce consumption of the graphite anodes and intermediate electrodes. Usually, the gas collection space in the electrolysis chamber is contained within a closure through which the anodes project. Preferably, there is provided also a single secondary hood surrounding the anodes, or a secondary hood surrounding each anode. The space(s) between the closure and the secondary hood(s) may be filled with inert gas.

The metal collection chamber may be sealed according to the method described in European Patent Application 82300893.3.

The number of intermediate bipolar electrodes per electrode assembly may conveniently be from 1 to 12. The electrodes may be arranged vertically or at a small angle to the vertical.

A level control device may be provided which may be a vessel, partly or wholly submerged in the electrolyte of the metal collection chamber, to or from which electrolyte can be transferred to alter the surface level. Alternatively the surface of the electrolyte/metal mixture may be maintained at a substantially constant level by controlled feeding and tapping of the cell, and without the need for such level control device.

Figure 2:
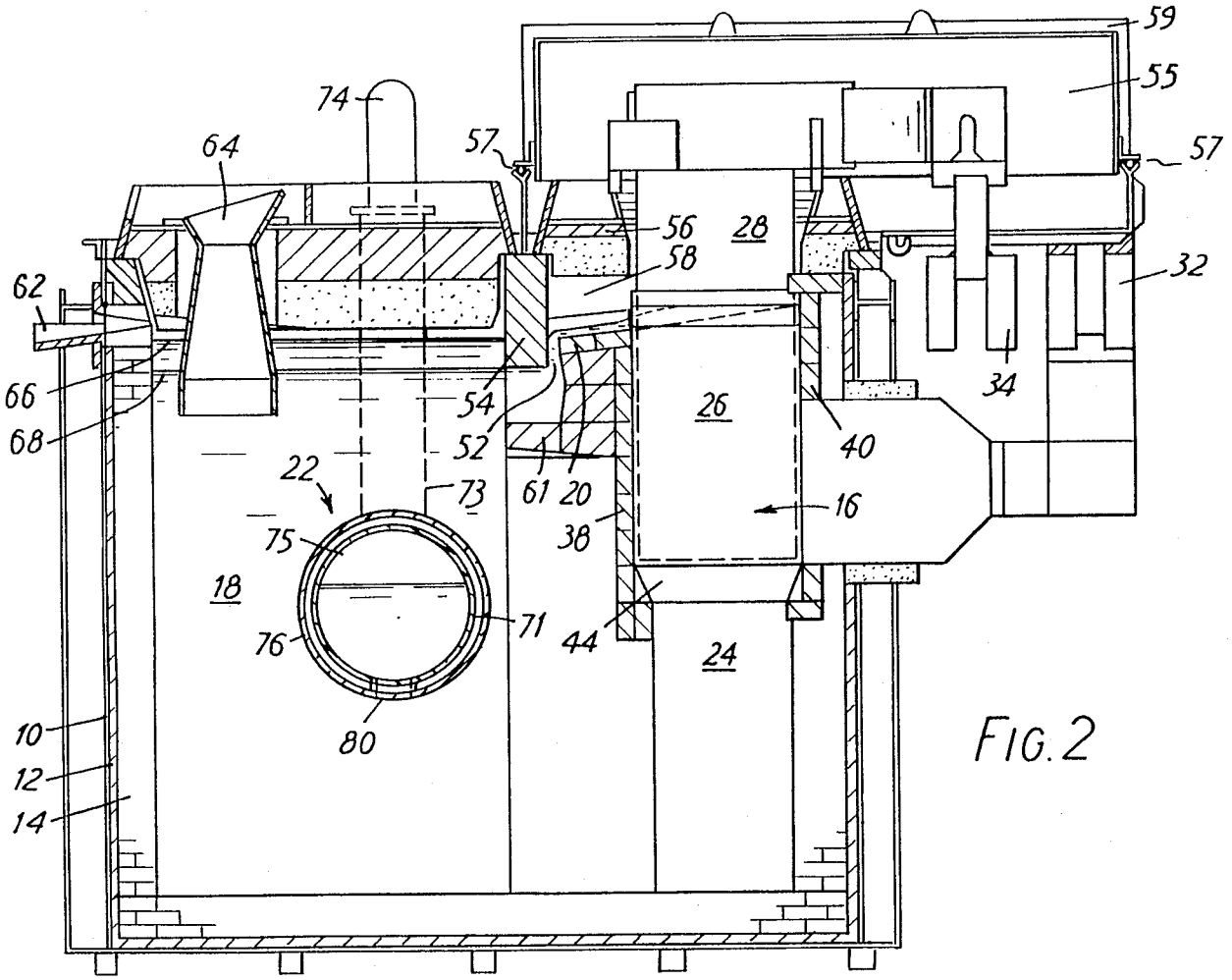
Figure 3:
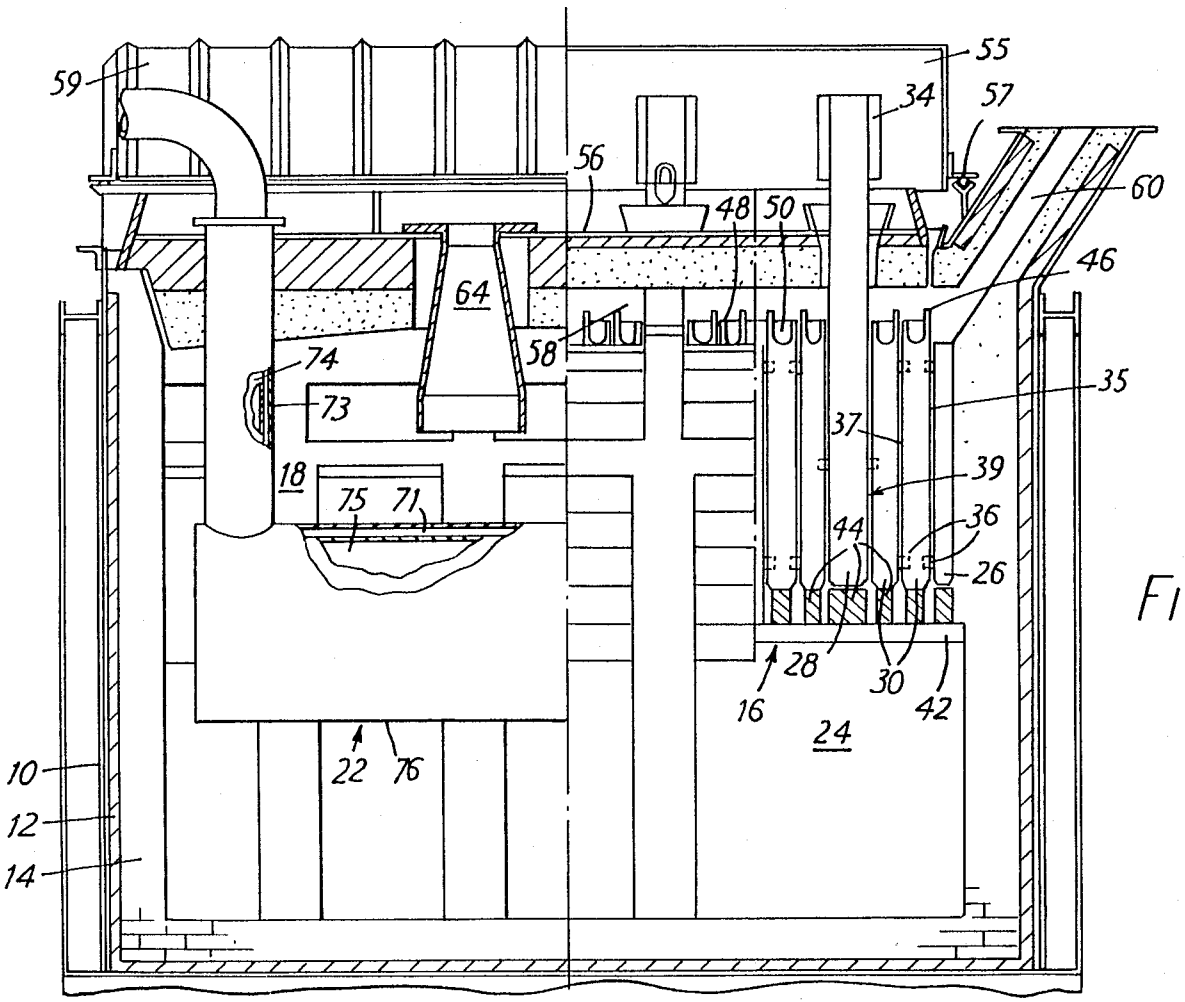
Figure 4A:
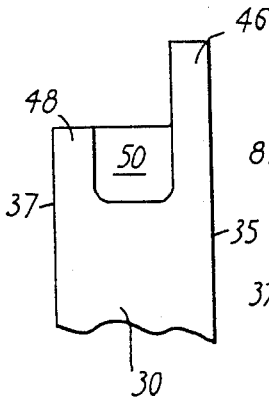
Figure 4B:
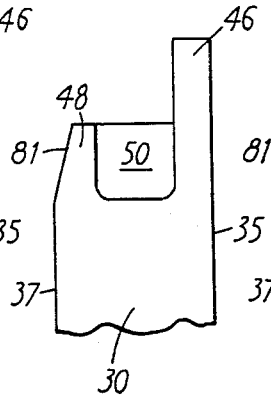
Figure 4C:
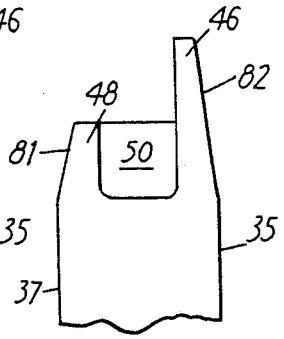
Figure 4D:
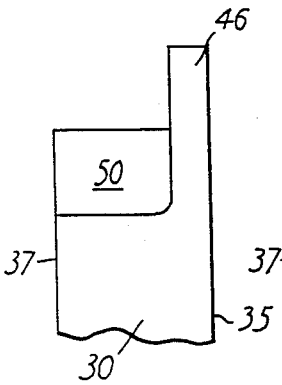
Figure 4E:
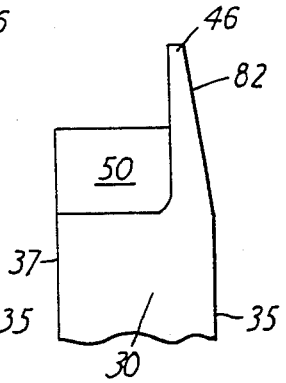
Figure 5:
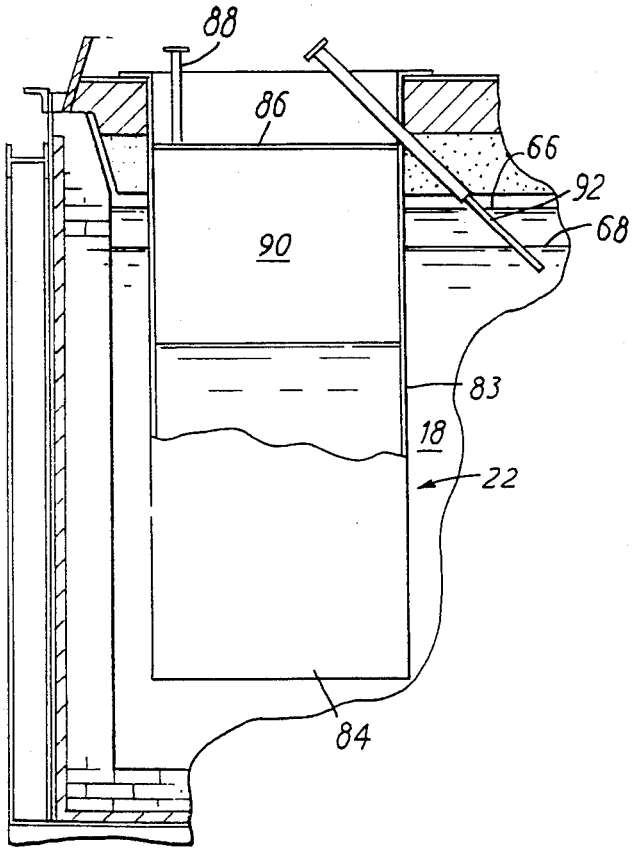

Reference is directed to the accompanying drawings, in which:

FIG. 1 is a plan view, partly in section, of an electrolytic cell according to the invention, FIG. 2 is a sectional side elevation of the cell, taken along the line A—A of FIG. 1, FIG. 3 is a sectional front elevation of the cell, taken along the line B—B of FIG. 1, FIGS. 4(*a*) to 4(*e*) are cross sections through the upper parts of various intermediate bipolar electrodes showing different types of channel, and FIG. 5 is a sectional side elevation, similar to FIG. 2, showing an alternative construction of level control device, Referring to FIGS. 1, 2 and 3, the electrolytic cell comprises a steel outer shell 10, a layer 12 of thermal insulation, and a massive refractory lining 14 of material which is resistant to both molten magnesium (when the cell is designed to produce magnesium) and the molten electrolyte to be used. The cell includes an electrolysis chamber 16, a magnesium collection chamber 18, a weir 20 over which electrolyte/magnesium mixture flows from the electrolysis chamber 16 to the magnesium collection chamber, a level control device 22 positioned in the magnesium collection chamber, and a return passage 24 leading from the magnesium collection chamber to the bottom end of the electrolysis chamber.

The electrolysis chamber 16 includes eight electrode assemblies, each consisting of a cathode 26, and anode 28 and two intermediate bipolar electrodes 30. The cathodes 26 are steel plates, connected to cathode busbars 32. There are five cathodes, one at each end of the chamber and the other three intermediate the anodes. There are four anodes 28, each a graphite slab connected to anode busbars 34. The two intermediate bipolar electrodes 30 in each assembly are also graphite slabs, each having an anodic face 35 facing its associated cathode, and a cathodic face 37 facing its associated anode.

The electrodes are spaced from one another by means of insulating spacers 36 located in holes in the graphite slabs, thus defining electrolysis region 39 between them. The cathodes 26 are shaped to be entirely immersed in electrolyte during operation of the cell, while the anodes 28 extend well above the surface of the electrolyte. The front and back walls, 38 and 40, of the electrolysis chamber are lined with refractory insulating bricks against which the electrodes abut. Each electrode is mounted on the bottom 42 of the electrolysis chamber on a refractory block 44 extending the length of the chamber, gaps being provided between the blocks to permit the flow of electrolyte with minimum leakage of electric current.

As seen in FIG. 3, the top edge of each intermediate bipolar electrode 30 is generally U-shaped in cross-section. The anodic face 35 extends upwards at 46 to above the intended level of the electrolyte surface. The purpose of this extension is to minimise current leakage over the top of the intermediate bipolar electrodes. The cathodic face 37 extends upwards at 48 to a height slightly below the intended level of the electrolyte surface. In between these extensions lies an open-top channel 50 extending longitudinally along the top of the electrode and sloping downwards towards the weir 20. This channel is intended to convey electrolyte/magnesium mixture to the magnesium collecting chamber substantially without contact with the chlorine that is continually rising up the electrolysis regions 39 between the electrodes.

On the front wall 38 of the electrolysis chamber, insulating blocks 20 constitute a series of weirs, one for each electrode assembly, which permit a controlled flow of electrolyte/magnesium mixture from the downstream ends of the channels 50 to the magnesium collection chamber 18. Adjacent the downstream end of each weir and forming with it a vertical channel 52, is a curtain wall 54 which dips into the electrolyte. This curtain wall 54 is the boundary between the electrolyte chamber and the magnesium collection chamber. With the roof 56 of the cell, it encloses a head space 58 above the electrolyte in the electrolysis chamber where chlorine accumulates and from which chlorine is removed by means of a pipe 60. A removable secondary hood 59 is provided to ensure that no air enters the electrolysis chamber. This hood 59, which is of steel, is seated on a sealing O-ring 57 mounted on the roof 56 of the cell. A space 55 is formed between the hood 59 and the roof 56 of the cell, and the tops of the anodes 38 project through the roof into this space. A potential problem is diffusion of gas from this space 55 through the anodes (which are to some extent porous) into the electrolysis chamber. This problem is avoided by either ensuring that the pressure in the space 55 is equal to or lower than that in the gas collection space 58, or by filling the space 55 with an inert gas such as argon. Alternatively, a separate removable secondary hood of similar design could be provided around each anode.

A baffle 61 directs the electrolyte/magnesium mixture below the curtain wall 54 and into the magnesium collection chamber 18. Here the electrolyte/magnesium mixture separates into a surface layer 66 of molten magnesium above an interface 68, the remainder of the chamber being filled with electrolyte. The chamber is provided with a tapping outlet 62 for molten magnesium, and a feeding cone 64 with an air lock for introducing electrolyte to a region below that occupied by magnesium metal.

The level control device 22 comprises a horizontal jacketed cylindrical vessel 76 closed at both ends and submerged in the electrolyte. The vessel is supported at both ends by pipes 72 and 74 which conduct air into and out of the jacket 71 as necessary to serve as a heat exchanger. The air inlet pipe 74 is insulated at 73 to avoid local freezing of metal (as described in European Patent Application 82300893.3). A small diameter pipe (not shown) enables argon to be fed into, or out of, the upper part 75 of the interior of the vessel. In the lower part of the vessel are holes 80 for the entry and exit of electrolyte. The surface of the electrolyte/magnesium mixture in the magnesium collection chamber can be raised by feeding argon into the vessel 76, thus expelling electrolyte, and can be lowered by bleeding argon out of the vessel. Automatic sensing means (not shown) can be provided to detect the surface level and to maintain it substantially constant e.g. during tapping of the magnesium or during introduction of magnesium chloride and other electrolyte components.

In operation, an electric current is passed between the anodes and cathodes in the electrolysis chamber. The electrolyte is a conventional mixture of alkali and alkaline earth metal chlorides and possibly also fluorides, including magnesium chloride, designed to be liquid at the chosen operating temperature just above the melting point of magnesium metal. Molten magnesium is formed on the cathodes 26 and on the anode-facing surfaces 37 of the intermediate bipolar electrodes 30. Chlorine is formed on the anodes 28 and on the cathode-facing surfaces 35 of the intermediate bipolar electrodes 30. A stream of rising chlorine bubbles fills the electrolysis regions 39 and the resulting upward flow of electrolyte entrains droplets of molten magnesium. Most of the electrolyte/magnesium mixture reaching the surface spills over the walls 48 into the channels 50 and flows along these, over the weir 20, down the vertical channel 52 and under the curtain wall 54. At this point, the liquid stream is essentially free of gaseous chlorine, but is still moving fast enough for the magnesium droplets to remain entrained in the electrolyte. In the magnesium collection chamber 18, the rate of flow is slower, and the molten magnesium collects at the surface and is removed. The rising chlorine gas in the electrolysis regions 39 pulls electrolyte from the magnesium collection chamber through the return passage 24 into the bottom end of the electrolysis chamber 16, thus completing the electrolyte circuit.

A key feature of the invention is the rate at which the electrolyte/magnesium mixture flows over the weir 20 and down the vertical channel 52 beyond. If the rate is too fast, and particularly if the flow is turbulent, chlorine gas will become or remain entrained in the liquid and will be carried over into the magnesium collection chamber where it will re-combine with magnesium, thus reducing efficiency. If the rate is too slow, the magnesium droplets may tend to coalesce and to adhere to the upstream side of the curtain wall. Control over the rate of flow can be exercised, partly by design of the region of the weir and partly by means of the level control device 22. In the cell illustrated, a suitable rate of flow is 0.1–0.6 m/s down the vertical channel.

Attention is directed to FIGS. 4(*a*) to (*e*) of the accompanying drawings which are cross-sections showing various designs of the longitudinal channel and other features of the top edge of the intermediate bipolar electrodes. The cross-section of FIG. 4*a* is similar to that shown in FIG. 3. The anodic face 35 of the electrode extends upwards to a horizontal wall 46 of rectangular cross-section. The cathodic face 37 extends upwards to another horizontal wall 48 of rectangular cross-section, but lower than 46. In between, lies an open-top channel 50 which slopes downwards towards a weir 20.

In FIGS. 4(*b*) and 4(*c*), the cathodic face of the wall 48 is chamfered at 81. In FIG. 4(*d*) and 4(*e*), the wall 48 has been omitted entirely. In FIGS. 4(*c*) and 4(*e*), the anodic face of the wall 46 has been chamfered at 82. The slope of the channels 50 will generally be in the range of 1:4 to 1:40, most usually 1:10 to 1:20.

Attention is directed to FIG. 5 of the accompanying drawings which shows an alternative construction of level control device in the magnesium recovery chamber. A metal cylinder 83 is mounted with its axis vertical. The lower end 82 is open and is immersed in electrolyte. The upper end 86 is above the surface of the electrolyte and is covered by thermally insulating material and closed except for a pipe 88 by which argon can be transferred into or out of the headspace 90. A refractory probe 92 is used to sense the level of the electrolyte surface, and to provide a signal to control the flow of argon into, or out of, the headspace 90 in the metal cylinder 83 so as to lower or raise the level of the electrolyte surface, for steady state operation at optimum level and to effect metal tapping.

EXAMPLE

A cell was constructed, as described, with interelectrode spacings of 8–11 mm. The slope of the channels 30 was 1:10. The cell was operated at a current density of 0.7 Amps/sq cm. The speed of flow of electrolyte down the vertical channel 52 was 0.4 meters/sec. The cell operated at a current efficiency of 70%. Prolonged operation was possible as a result of the slow consumption of graphite from the anodes and intermediate bipolar electrodes.

I claim:

1. An electrolytic cell for the production of metal by electrolysis of a molten chloride electrolyte which is more dense than the metal, comprising an electrolysis chamber 16 including at least one electrode assembly of an anode 28, a cathode 26 and at least one intermediate bipolar electrode 30, the electrodes being arranged substantially vertically with substantially vertical electrolysis regions 39 between them, and a gas collection space 58 above the assembly, a metal collection chamber 18 in communication with the top and the bottom of the electrolysis chamber, but screened from the gas collection space, a weir 20 to permit a controlled flow of electrolyte/-metal mixture from the top of the electrolysis chamber to the metal collection chamber, said weir being positioned at one end of the or each electrode assembly and extending transversely to the electrodes, and means 22 for maintaining the surface of the electrolyte/metal mixture in the electrolysis chamber at a substantially constant level, the or each intermediate bipolar electrode having an anodic face which extends upwards to a height above the intended level of the electrolyte/metal mixture surface, a cathodic face which extends upwards to a height slightly below the intended level of the electrolyte/metal mixture surface, and a longitudinally-extending open-top channel 50 which slopes downwards toward the weir to convey electrolyte/metal mixture from the electrolysis region towards the weir.

2. A cell as claimed in claim 1, wherein the interelectrode spacing is from 4 mm to 25 mm.

3. A cell as claimed in claim 1, wherein the gas collection space is provided with a closure through which the anode(s) project, and there is provided a secondary hood surrounding the anode(s).

4. A cell as claimed in claim 1, wherein the means for maintaining the surface of the electrolyte/metal mixture in the electrolysis chamber at a substantially constant level comprise a level control vessel partly or wholly submerged in the electrolyte of the metal collection chamber, to or from which electrolyte can be transferred.

5. A cell as claimed in claim 4, wherein the level control vessel is a jacketed cylindrical vessel submerged in the electrolyte, provided with means for supplying air to the jacket for heat exchange purposes and means for transferring electrolyte to or from said vessels interior.

6. A cell as claimed in claim 1, wherein the open-top channel is bounded on both sides by the said anodic face and the said cathodic face of the intermediate electrode.

7. A cell as claimed in claim 1, wherein the channel has a slope of from 1:4 to 1:40.

* * * * *